United States Patent [19]

Bilson et al.

[11] 4,229,779

[45] Oct. 21, 1980

[54] LUMINAIRE WITH ARCUATE REFLECTOR

[75] Inventors: Edward B. Bilson; Alfred H. Brown, III, both of Memphis, Tenn.

[73] Assignee: International Telephone and Telegraph Corporation, Chicago, Ill.

[21] Appl. No.: 907,499

[22] Filed: May 19, 1978

[51] Int. Cl.[2] ..... F21V 7/12

[52] U.S. Cl. ..... 362/217; 362/260; 362/296; 362/348

[58] Field of Search ..... 362/217, 260, 290, 297, 362/346, 347, 348, 349, 350; 350/294;

[56] References Cited

U.S. PATENT DOCUMENTS

| | | | |
|---|---|---|---|
| 1,461,362 | 7/1923 | Lyles | 362/348 |
| 1,805,886 | 5/1931 | Rizer | 362/350 |
| 1,900,551 | 3/1933 | Guth | 362/348 |
| 1,913,517 | 6/1933 | Smith et al. | 362/217 |
| 1,913,519 | 6/1933 | Smith et al. | 362/217 |
| 2,717,954 | 9/1955 | Rex | 362/217 |
| 3,251,984 | 5/1966 | Colterjohn | 362/346 |
| 3,588,492 | 6/1971 | Pollock | 362/347 |
| 3,679,893 | 7/1972 | Shemitz et al. | 362/350 |
| 4,027,151 | 5/1977 | Barthel | 350/294 |

FOREIGN PATENT DOCUMENTS

| | | | |
|---|---|---|---|
| 660004 | 6/1965 | Belgium | 362/348 |
| 864684 | 1/1953 | Fed. Rep. of Germany | 362/348 |
| 531923 | 8/1955 | Italy | 362/347 |

*Primary Examiner*—L. T. Hix
*Assistant Examiner*—Alan Mathews
*Attorney, Agent, or Firm*—James B. Raden; Marvin M. Chaban; Harold J. Holt

[57] ABSTRACT

A luminaire for illuminating a surface area spaced from the luminaire nadir to a distance from its elevated mounting. The luminaire has an elongated light source with its axis substantially parallel to the surface being illuminated. A specular reflector disperses the light over a range from substantially the light nadir to a line about 73° from the nadir. With the present construction, a series of beams, each of about 1° in angular extent, is approximated to provide uniform light distribution over a designated angular spread with sharp cutoffs beyond the spread with a high utilization factor for the light generated. The reflector is configured to prevent reflected light from passing through the light source although beams of at least one section are directed in paths closely adjacent to the light source.

8 Claims, 3 Drawing Figures

LUMINAIRE WITH ARCUATE REFLECTOR

BACKGROUND OF THE INVENTION

Luminaires having reflectors with sections having different configurations are known, as for example, U.S. Pat. Nos. 4,027,151 issued on May 31, 1977 to F. Barthel and 3,679,893 issued July 25, 1972 to S. Shemitz. In the latter of these, a concave reflector having a parabolic reflecting surface and an elliptic reflecting surface is shown used to provide a uniform magnitude of illumination on a plane. The first named patent shows a three section reflector, two of the sections being generated by the use of a fourth degree polynomial equation.

The combination of elliptic and parabolic sections is also shown by U.S. Pat. No. 2,717,954 to C. Rex issued Sept. 13, 1955.

These patents are illustrative of some combinations of shapes which have been used to provide light from an asymmetric luminaire to illuminate an area or surface extending from the nadir of the luminaire; the luminaire being mounted an appreciable vertical distance above the area surface being illuminated. The luminaires shown also employ a horizontally elongated light source.

Other patents directed to reflectors which have some similarity to that of the present invention are U.S. Pat. No. 1,805,886 issued May 19, 1931 for an automobile headlight, U.S. Pat. Nos. 1,913,517 and 1,913,519 to Smith et al both issued June 13, 1933, also for automobile headlights. U.S. Pat. Nos. 3,251,984 to Colterjohn issued May 17, 1966 shows a flashbulb for a camera in which the reflector is configured to minimize the incidence of reflected light passing through the lamp tube.

SUMMARY OF THE INVENTION

The invention is directed to an improved reflector configuration for a luminaire to provide substantially uniform illumination for a ground plane extending from the lamp nadir a distance defined by light rays at acute exit angles from the luminaire.

It is an object of the invention to provide a luminaire having an improved reflector structure comprised essentially of two sections, a first being formed by a series of adjacent circular segments of fixed angular extent and of sequentially changing radius. The second section comprises a series of parabolic segments of equal angular extent with the focus of the parabolas on the lamp axis.

It is a further object of the invention to provide a luminaire having a reflector with a smooth continuous arcuate surface comprised of a first series of sections of circular cross-section of limited angular extent leading into a segment comprised of parabolic sections of like limited angular extent, the reflector being designed to reflect light no closer than a fixed distance from the focus of the reflector segments to similate a plurality of beams each emanating at a different exit angle from the luminaire to illuminate a spectrum of fixed angular extent with relatively uniform illumination and sharp cutoff at the ends of that spectrum.

It is a still further object of the invention to provide a reflector for a luminaire with a tubular light source in which no light redirected by the reflector passes through the light source, the closest of the reflected light rays missing the source by minimal distances.

It is another object of the invention to provide a luminaire having an elongated light source with a reflector arrayed about the source to produce a series of beams reflected to pass closely adjacent the light source and to produce an illumination spread over an area of relatively uniform intensity over the area.

DETAILED DESCRIPTION OF THE DRAWINGS

Figure 1:
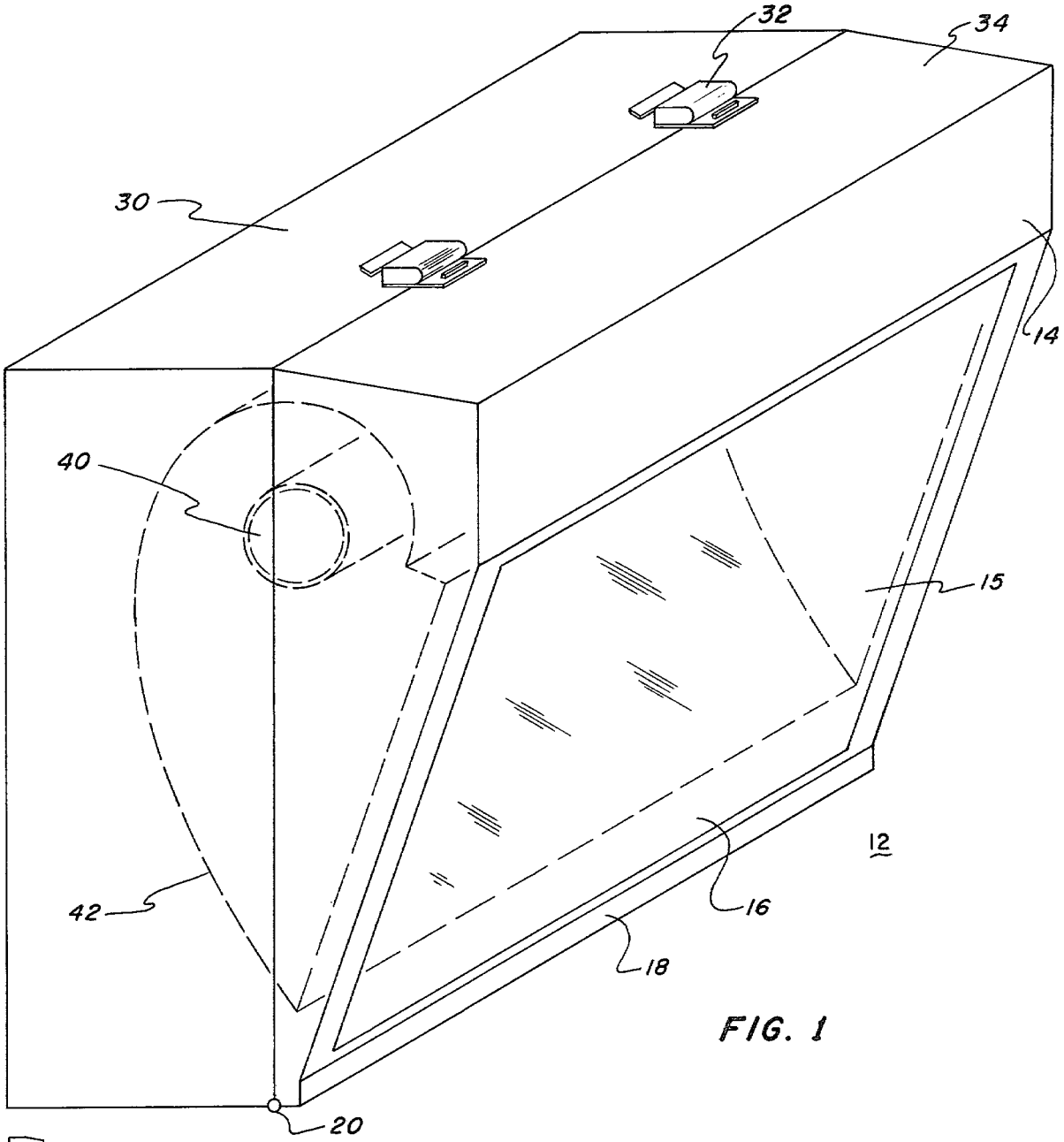
FIG. 1 is a perspective view of a luminaire using the present invention.

The luminaire 12 of FIG. 1 is rectangular longitudinally and in its transverse section has a tapering front face 14 in an otherwise essentially rectangular enclosed housing including metal sides 15. The front face 14 includes a refractor or lens 16 within a framing structure 18 pivotal about an axis 20 adjacent its lower edge. The lens 16 is mounted within a support framing structure 18 pivotally secured to the main luminaire housing 30. The housing 30 may be fabricated of suitable enclosing sheet metal or the like and is secured by releasable toggle clamps 32 at its upper framing section 34. The housing and lens preferably provide weatherproof structure to enable the luminaire 12 to be mounted outdoors in a conventional fashion.

The luminaire 12 has an essentially horizontally disposed light source which may be a lamp tube 40 such as high pressure sodium suitably secured within the housing adjacent its upper end and above the vertical extent of the lens 16. Disposed about the lamp tube 40 within housing 30 is a reflector 42 which is asymmetrically mounted about the lamp tube.

Figure 2:
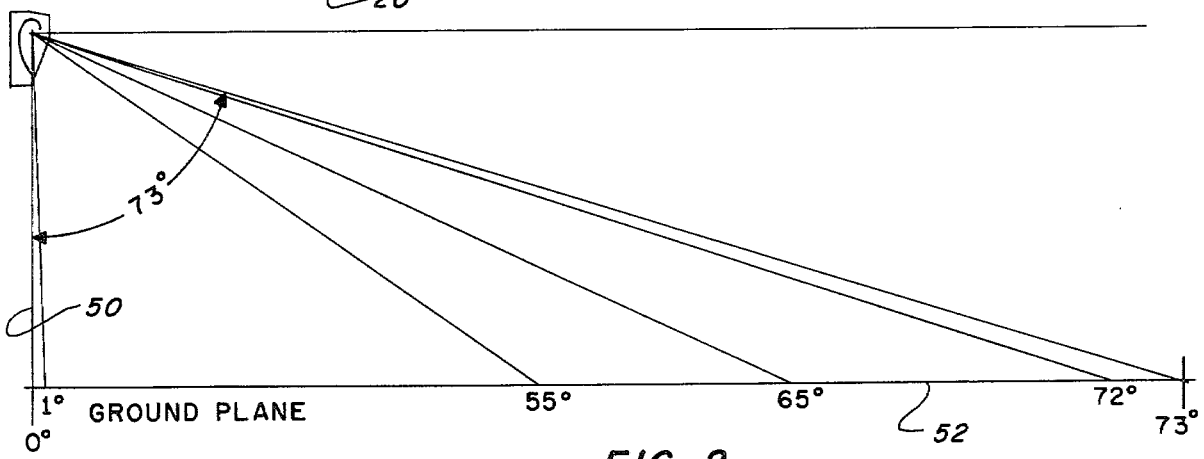
FIG. 2 is a diagrammatic side view in elevation of a luminaire according to FIG. 1 mounted on a support to illuminate a horizontal surface.

When mounted on a mounting such as pole 50 of FIG. 2, the luminaire 12 will illuminate a ground surface such as that represented by line 52 from the lamp nadir at 0° relative to the luminaire mounting to an elevation of 73° from nadir with relatively uniform illumination.

Figure 3:
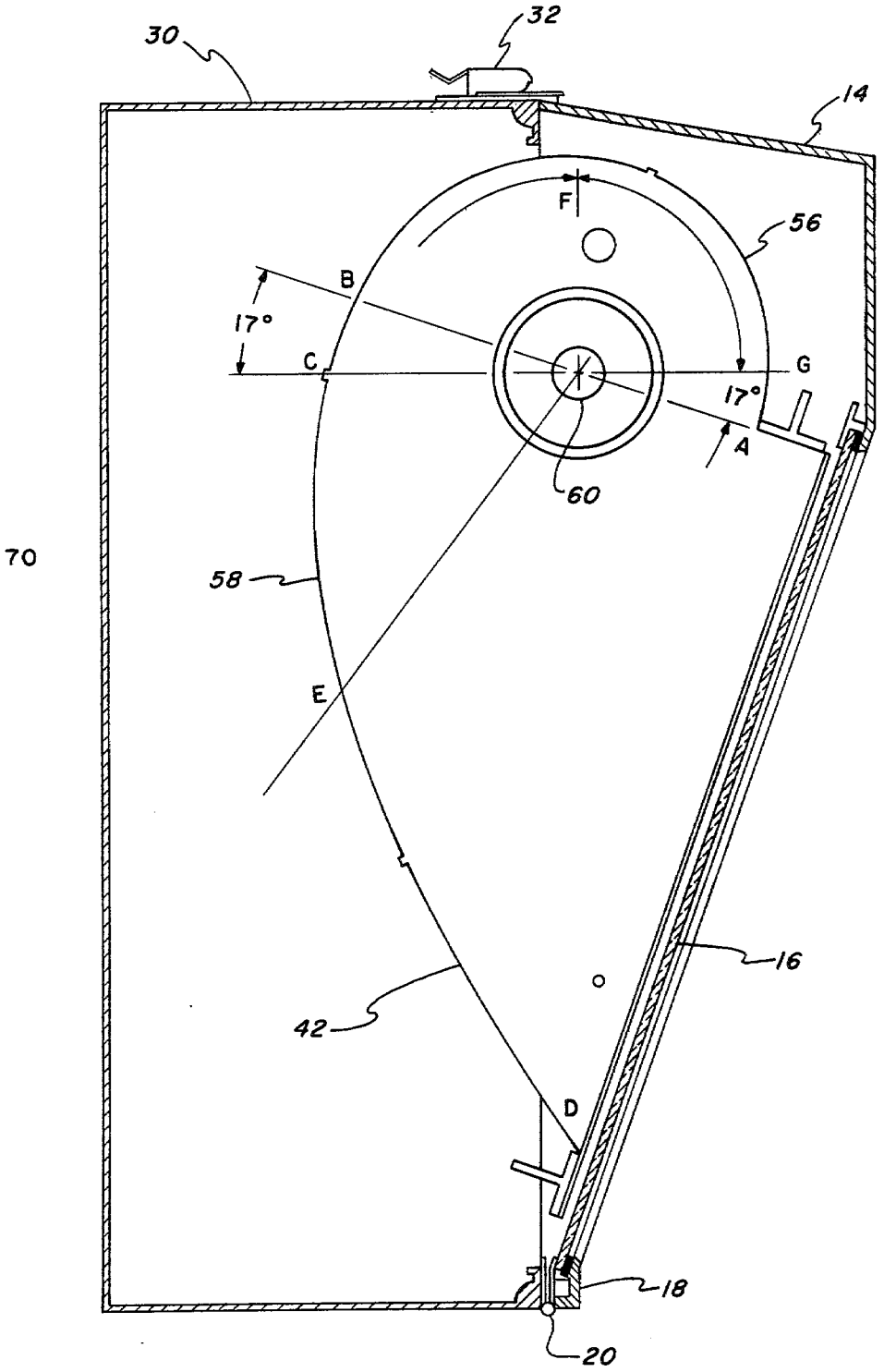
FIG. 3 is a transverse cross-sectional view of the luminaire of FIG. 1.

In FIG. 3, we show the configuration of the specular reflector 42 in section, the longitudinal extent of the reflector being uniform in section fabricated in any conventional manner and of any conventional reflective material. The reflector 42 includes two main segments, a first segment 56 and a second segment 58. The segments are joined to form a continuously curved reflector. Of the segments, segment 56 extends for no more than 180° from point A to point B. As can be seen in FIG. 3, point A on the periphery of the reflector is located at a level which may be approximately 17° below the horizontal on a line extending through the axis of the lamp tube 40. The position of the edge A of the reflector corresponds to the spread angle of 73° from the vertical (or nadir) as shown by FIG. 2.

The position of point B is 180° from that of point A with tolerance of +0°, −5° to 10°. The shape of this segment 56 is a smooth continuous curve. This curve is derived by joining sections of 2° angular extent. Each section comprises 2° of the arc of a circle with its center on a circle 60 of radius of $\frac{3}{8}''$ from the axis of the lamp tube. Each successive section in the direction from A to B has a radius greater than its predecessor by a small amount to the extent that the radial distance for the arc at point B is approximately one inch greater than the radial distance at point A, both distances being measured from the closest point on the periphery of circle 60. This portion of the reflector is directed to the area from nadir (0° to 55°) as shown by the chart of FIG. 2. Naturally, the direct light from the lamp tube is reinforced by the reflected light over this portion of the area coverage. Within section 56, light striking the area between points F and G are twice redirected and those from point F to point B are singly directed before exit from the luminaire.

The area on the ground plane from 55° to 73° as shown by FIG. 2 receives direct light from the luminaire and light reflected from the section 58, extending between points B and D on the reflector 42. Section 58 is comprised of a series of parabolas of successively greater foci. Each individual parabola constitutes one degree of arc meeting the general formula for a parabola. In this manner, a series of points may be generated using the tube circle 60 as the line on which the foci of the respective parabolic segments are located. These one degree segments are combined in the continuous smooth curve of section 58 which extends from points B to D.

To develop the section from B to D mathematically, the section may be divided into two portions, a first portion extending from point B to point E and the second from point E to point D. The portion B-E is derived using the formula:

$$R = 1.290\theta^2 - 9.14\theta + 19.5$$

where R = radius in inches from the periphery of the circle 60 (at the point closest to the reflector) and theta ($\theta$) represents radians. $T^1$ This segment extends over an arc of about 70° for the beams which would illuminate the area from 55° to approximately 65° on the ground plane of FIG. 2.

The third section (from E to D) is also comprised of segments of one degree of arc joined in a continuous curve with minor changes in each focal distance to constitute a continuous curve. Mathematically, such a curve would be met by the formula $R^{.517}\theta = 5.47$. This portion of the reflector from point E to point D is used to illuminate the furthest area of the ground plane from 65° to 73°.

The underlying philosophy in design of the present reflector is to provide uniformity of illumination on the ground. Thus, the reflector would tend toward a straight line in its longer portion with a maximum of foot candles. The circular cross-section portion is designed to prevent reflected light from passing through the arc tube which in some conventional lamps has a diameter of 7 millimeters. The principle employed was to produce approximately 73 spaced beams each one degree of exit angle in width and each providing relatively uniform light on the ground at the area to which each beam is directed. The amount of light generated to illuminate the area from 72° to 73° must be considerably greater than that from 0° to 1° in view of the greater distances from the luminaire to the area on the ground plane and in view of the greater ground distance from 72° to 73° than from 0° to 1°.

What is claimed is:

1. A luminaire adapted to illuminate a surface spaced from an elevated mounting of said luminaire, said luminaire including an elongated substantially horizontal tube light source, a concave, elongated reflector circumposed about said light source for reflecting light from said source, the invention wherein said reflector produces a plurality of parallel beams of light emanating from said light reflected within said luminaire, each said beam encompassing approximately one degree of exit angle to illuminate a portion of the surface, said reflector configured to produce light of substantially uniform intensity across said surface for a distance encompassed by said beams in which said reflector is comprised in profile of a first portion and a second portion, said first portion comprising a smooth continuous curve generated by adjoining cylindrical sections of successively increasing radii in the direction toward said second portion and said second portion comprising adjoining sections, each having the optical characteristics of a parabola with each successive parabola being of successively increasing focal length in the direction away from said light tube.

2. A luminaire as claimed in claim 1, in which said reflector first portion extends from a point at approximately 17° below a horizontal plane through the light source and the reflector, and said second portion extends from its joinder to the first portion to its lower end.

3. A luminaire as claimed in claim 1, in which the cross-section of said reflector for said first and second portion is uniform across the lateral extent of the luminaire and the radii extend from the respective closest points on the circumference of a circle outwardly adjacent the arc tube of said light source to the respective sections on the surface of the reflector.

4. A luminaire as claimed in claim 3, in which each successive radius in said first portion is greater than the preceding radius by approximately 0.055" to 0.010".

5. A reflector for a luminaire having an elongated substantially horizontal tube source of light within the reflector for illuminating a surface spaced a distance from base of the luminaire to a line spaced therefrom, the reflector comprising an elongated continuous surface of uniform cross-section in the direction of the elongation of both the light source and said surface, the reflector comprising a first portion of approximately 180° radial extent positioned above the tube and a second portion of somewhat greater than 90° extent continuing from said first portion, said first portion forming a smooth continuous curve eccentric to said tube, said first portion being formed of a series of circular arcs of successively increasing radius in a direction toward said second portion, said second portion comprising a smooth continuous curve formed of a series of parabolas of successively increasing focal length to produce beams corresponding to the respective exit angles of light from the parabolas.

6. A reflector as claimed in claim 5, in which each of said radii extends from the circumference of a circle concentric about the axis of the arc tube and closely adjacent thereto and said focal lengths extend from the axis of the tube.

7. A reflector as claimed in claim 6, wherein the arcs of said first porion each include two degrees of included arc, and wherein said parabolas of said second portion each comprise one degree of included arc.

8. A reflector as claimed in claim 7, in which light from said tube striking certain of the arcs of said first portion are redirected twice before passing out of said luminaire toward the surface being illuminated.

* * * * *